United States Patent [19]

Michael

[11] 3,965,837

[45] June 29, 1976

[54] VESSEL HAVING IMPROVED WAVE RESPONSE CHARACTERISTICS

[75] Inventor: Farid Y. Michael, Houston, Tex.

[73] Assignee: Brown & Root, Inc., Houston, Tex.

[22] Filed: May 1, 1975

[21] Appl. No.: 573,531

[52] U.S. Cl. ..... 114/125

[51] Int. Cl.[2] ..... B63B 39/03

[58] Field of Search ..... 114/121, 122, 125

[56] References Cited

UNITED STATES PATENTS

| | | | |
|---|---|---|---|
| 1,065,549 | 6/1913 | Reid et al. | 114/125 |
| 3,327,672 | 6/1967 | Field | 114/125 |
| 3,797,440 | 11/1971 | Pangalila | 114/125 |

*Primary Examiner*—Duane A. Reger
*Assistant Examiner*—Sherman D. Basinger

[57] ABSTRACT

A barge includes port and starboard sides in which longitudinal troughs are formed. Each trough is bounded at its top by an outwardly directed undersurface of an upper wing section and bounded at the bottom by an outwardly directed topsurface of a lower wing section. The topsurface of the lower wing section is located for submersion during offshore operations to oppose heave and roll motions of the barge. An upper ballast system is provided in the upper wing sections to carry ballasting fluid above the center of the barge. A lower ballast system is provided in the lower wing sections to carry ballast fluid below the barge center. Operation of the upper and lower ballast systems enables a unique control of floatation characteristics to be provided. Namely, by ballasting the upper ballast tanks, the center of gravity is raised and the metacentric height is reduced. Deballasting of the upper ballast tanks causes a lowering of the center of gravity and an increase of the metacentric height. By ballasting the lower ballast tanks, the center of gravity is lowered and the metacentric height is increased. Deballasting of the lower ballast tanks causes the center of gravity to be raised and the metacentric height to be reduced. Plates can be attached in spaced relation along the troughs to break the momentum of the waves and also to dampen rolling motions of the barge.

5 Claims, 9 Drawing Figures

VESSEL HAVING IMPROVED WAVE RESPONSE CHARACTERISTICS

BACKGROUND AND OBJECTS OF THE PRESENT INVENTION

The present invention relates to floatable vessels, and more particularly to a hull construction for improving the wave-response behavior of a floating barge.

Offshore activities, especially those connected with the discovery and recovery of crude oil, are often conducted from floating vessels, such as pipe-laying barges, pipe-burying barges, derrick barges, drill barges, and numerous other forms of support barges and ships. Many of these vessels are characterized by high statical stability due to a relatively large metacentric height, thus making them highly resistant to capsizing.

On the other hand, features which typically establish high statical stability are generally responsible for low dynamic stability, meaning that the vessels are highly responsive to wave motion. In relatively calm waters, low dynamic stability can be tolerated. However, oil-related activities are presently being conducted in regions where severely rough wave conditions are prevalent, such as in the North Sea, where low dynamic stability presents serious drawbacks.

Vessels of high static stability can operate in such rough sea regions with minimal likelihood of capsizing. However, the low dynamic stability of these vessels results in severe ship motion, especially in roll and heave, which can hamper or prevent the conductance of normal onboard activities during rough sea conditions.

It is, therefore, an object of the present invention to minimize or obviate problems of this sort.

It is another object of the invention to provide a floatable vessel whose dynamic and statical stability permit satisfactory barge operation in both calm and rough seas.

It is yet a further object of the invention to provide such a vessel whose metacentric height can be adjustably regulated.

It is still another object of the invention to provide a vessel which exhibits a high resistance to capsizing as well as a considerably long natural period of roll.

It is a further object of the invention to provide such a vessel whose overall dimensions are not unlike that of a conventional barge and yet which is characterized by longitudinally troughed sides, and buoyancy equipment above and below water level for selectively altering the metacentric height of the vessel.

It is still another object of the invention to provide a unique method for modifying a conventional vessel in accordance with the previously outlined objects, as well as a novel method for operating such a barge to regulate the metacentric height.

BRIEF DESCRIPTION OF A PREFERRED EMBODIMENT OF THE INVENTION

These and other objects are accomplished by the present invention which involves a floatable vessel having a hull with top and bottom portions and port and starboard side portions. The top portion includes a working deck capable of carrying personnel and equipment. Each of the port and the starboard side portions are defined by vertically spaced upper and lower wing sections which form an outwardly open, inwardly closed trough section vertically therebetween. The trough section is bounded at the top by an outwardly directed undersurface of the upper wing section and at the bottom by an outwardly directed topsurface of the lower wing section. The trough section includes a mouth extending between an outer end of the upper wing section and an outer end of the lower wing section to emit water into the trough section. The topsurface of the lower wing section is located for submersion during offshore operations to oppose upward motion of the vessel in heave and roll. An upper ballast tank is disposed to carry ballasting fluid above the center of the barge. Mechanism is provided for ballasting the upper tank to raise the center of gravity and reduce the metacentric height of the vessel, as well as for deballasting the upper tank to lower the center of gravity and increase the metacentric height of the vessel. A lower ballast tank is disposed to carry ballasting fluid below the center of the barge. Mechanism is provided for ballasting the lower tank to lower the center of gravity and increase the metacentric height of the vessel, as well as for deballasting the lower tank to raise the center of gravity and reduce the metacentric height of the vessel.

A plurality of vertical plates may be disposed to extend along each trough between the upper and lower wing sections. The plates are horizontally spaced to define openings along each vessel side trough which seawater may freely pass. The plates are arranged to retard the passage of water from the troughs to dampen rolling motions of the vessel. Also, the plates provide means for breaking the momentum of the wave body at the side of the vessel, thus dissipating energy which would have otherwise been transmitted to the vessel and cause the vessel to respond. This feature is more effective for wave heights equal to or less than half the outer trough height.

THE DRAWINGS

Other objects and advantages of the present invention will become apparent from the subsequent detailed description thereof in connection with the accompanying drawings in which like numerals designate like elements, and in which.

Figure 9:
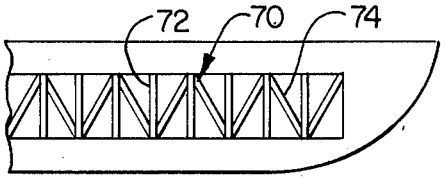
Figure 6:
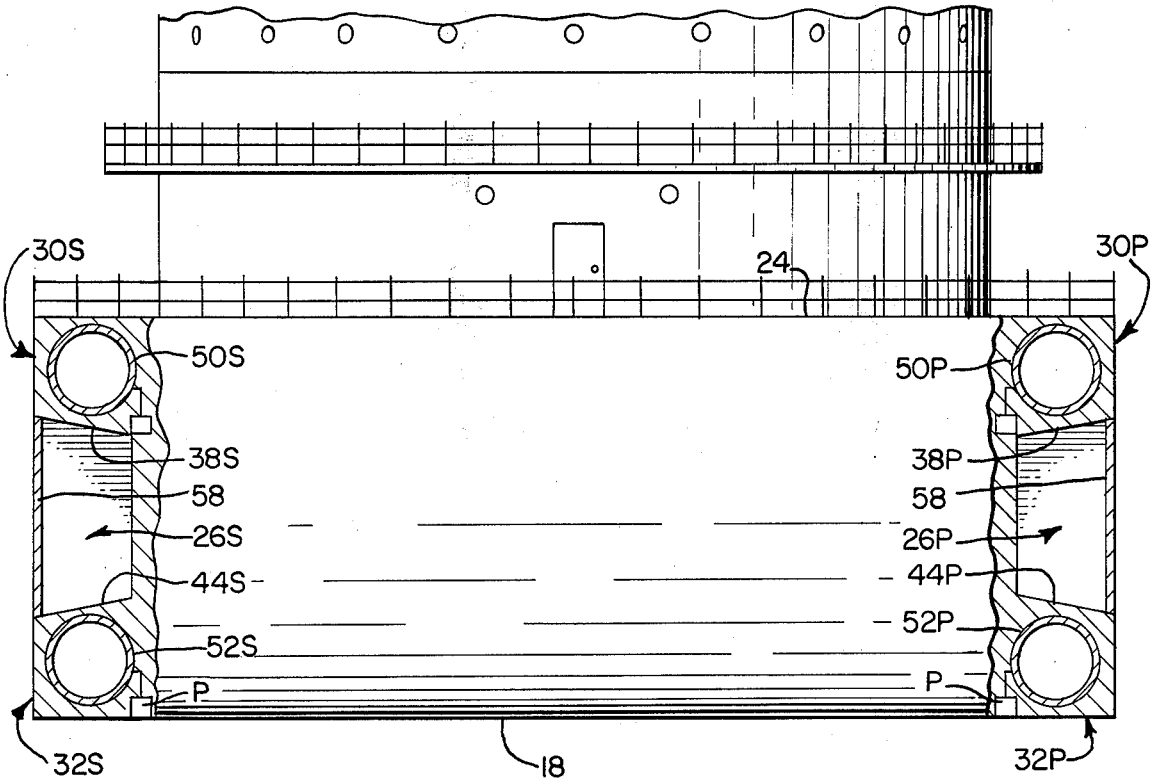
FIG. 6 is a front view of the barge of FIG. 4 with parts being broken away.

FIG. 9 provides a fragmentary side elevational view of an alternative form of the trough plate arrangement depicted in FIG. 6.

DETAILED DESCRIPTION OF THE PREFERRED EMBODIMENT

Features of the present invention will be explained with reference to a floating barge, although it will be understood that the present invention has utilization in other types of floating vessels as well.

Barges enjoy wide use in offshore activities such as oil discovery and recovery operations. A barge is typically characterized by a high degree of static stability as a result of its relatively large metacentric height, and is thus able to avoid capsizing even in very rough water.

On the other hand, features which render the barge statically stable, also render the barge relatively unstable dynamically. That is, a conventional barge typically has a relatively low natural rolling period and thus is highly responsive in roll, as well as in heave, to wave motion. For these reasons, among others, a barge operating in a rough sea is subject to considerable motion, thus rendering it extremely difficult for onboard personnel and equipment to carry out necessary activities. Due to the increasingly large number of activities being carried out in rough sea regions, such as the North Sea, the need for barges which exhibit a high dynamic stability is readily apparent.

The present invention involves a unique hull construction which achieves a relatively high natural rolling period, while maintaining an acceptable level of static stability. While features of the present invention can be built into a vessel at the time of its initial fabrication, an existing vessel can be conveniently modified to incorporate the features. Consequently, the cost of constructing an entirely new fleet is avoided.

Figure 1:
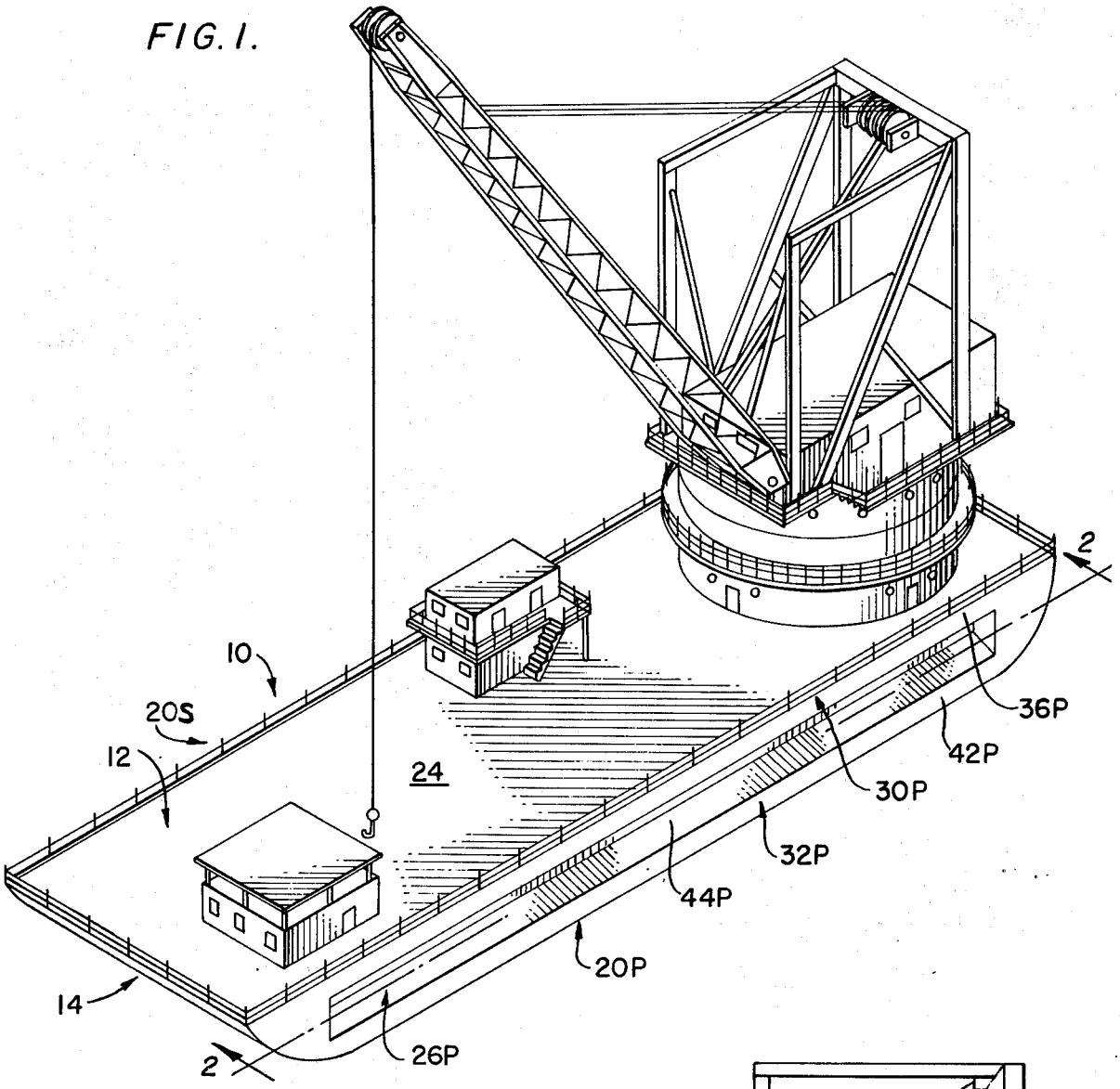
FIG. 1 is a perspective view of a troughed barge in accordance with one preferred embodiment of the present invention.
Figure 2:
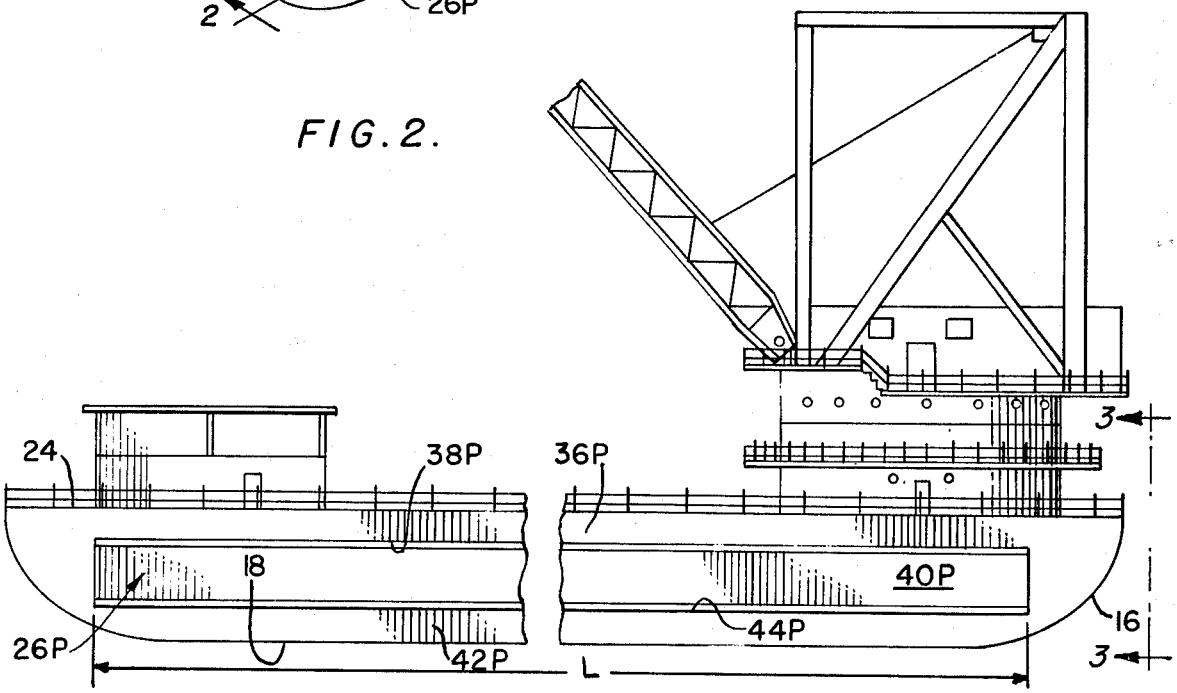
FIG. 2 is a side elevational view of the barge depicted in FIG. 1.
Figure 3:
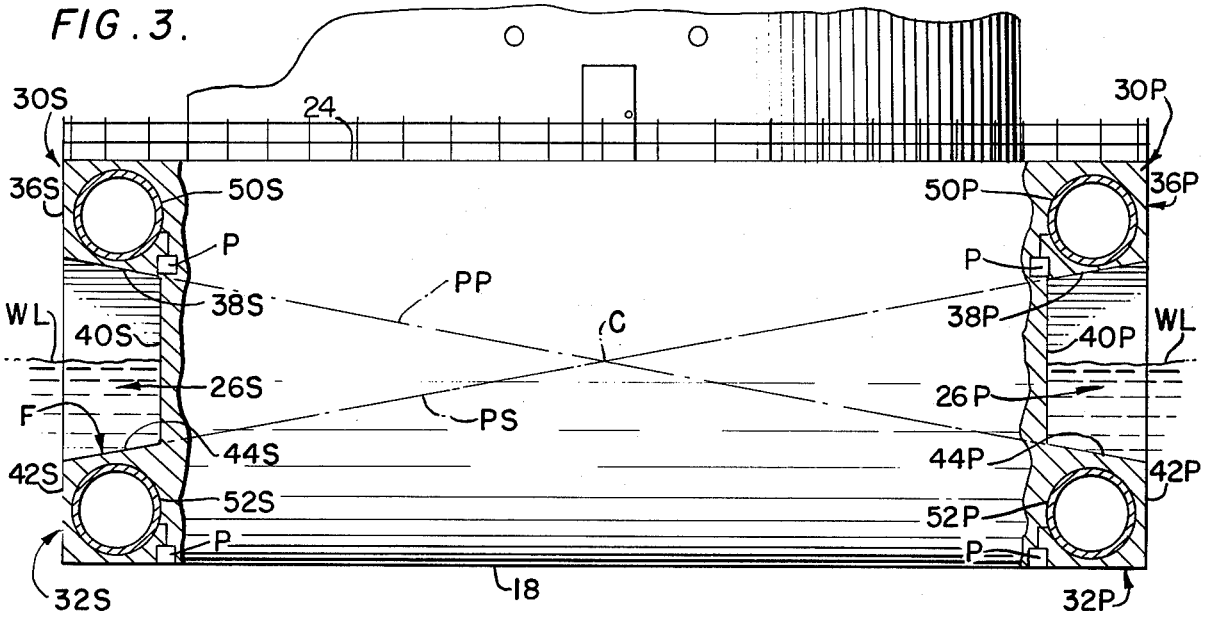
FIG. 3 is a front view of the barge of FIG. 1 with parts being broken away.

FIGS. 1–3 depict a conventional barge 10 which has been modified in accordance with the present invention. The barge can be of any particular type which is to be used in the performance of offshore activities, and where a steady working deck is particularly desired. The barge includes a top portion 12, a front portion 14, a rear portion 16, a bottom portion 18, a starboard side portion 20S, and a port side portion 20P. The top portion 12 provides a working deck 24 capable of carrying personnel and equipment. Within the barge, below the working deck, are contained various conventional storage areas and living quarters, not shown.

In accordance with the present invention, the port and starboard side portions of the barge have inwardly recessed segments. That is, longitudinal trough sectins 26S, 26P are formed in the starboard and port sides of the barge. This can be accomplished in an existing barge by cutting and welding so as to, in effect, inwardly relocate a central portion of each barge side wall. Alternatively, the upper and lower portions of each barge side can be extended outwardly to form the trough sections. In a conventional barge having a length of 650 feet, a cross-sectional width of 140 feet, and a height of 50 feet, the trough could extend inwardly by about 20 feet. Other trough sizes might be desirable, depending upon the barge size and required motion behavior.

Above and below each of the troughs, there is an upper wing section 30S, 30P and a vertically spaced lower wing section 32S, 32P. These wing sections, together with the outwardly open, inwardly closed trough sections 26S, 26P, constitute the port and starboard sides of the barge.

When modifying an existing barge, each upper wing section is defined by outer parts of the barge deck 24, an upper side wall portion 36S, 36P of the barge original side, and an undersurface 38S, 38P. The undersurface includes an outer end connected to the upper side wall portion 36S, 36P, and an inner end connected to an upstanding surface 40S, 40P which forms the inner boundary of the trough.

Alternatively, the troughs can be formed by adding upper and lower wing sections onto an existing barge.

Each lower wing section 32S, 32P is defined by the outer parts of the barge bottom 18, a lower side wall portion 42S, 42P of the barge original side, and a topsurface 44S, 44P. This topsurface includes an outer end connected to the lower side wall portion 42S, 42P, and an inner end connected to the upstanding surface 40S, 40P.

The length L of each trough is at least one half the barge length (see FIG. 2). The trough can extend the entire length of the barge, if desired, but preferably is terminated at a distance from the front and rear barge ends. A suitable trough height may comprise an inner height of 10 feet and an outer height of 14 feet (FIG. 3), although heights of other magnitude might be preferred in some cases.

If desired, a double wall type of construction (not shown) can be provided at the inner end of the trough so as to define a void space inwardly of the upstanding surface. Such construction would provide a buffer in the event that damage occurs to the wall.

Each trough, at its open end, defines a mouth extending between the outer end of the undersurface 38S, P and the outer end of the topsurface 44S, P. The trough is designed such that the water level of the body of water intersects the mouth of each trough, thereby locating a quantity of water in the trough above the topsurface.

Desirably, the trough will be arranged so that the waterline intersects the mouth at a level which provides sufficient draft for the barge, as well as sufficient spacing below the undersurface to minimize battering of the undersurface by waves. With such criteria in mind, it is expected that, in moderately calm sea conditions, the water level WL will intersect the trough at about its vertical midpoint (see FIG. 3).

It will be apparent that through the provision of an outwardly open trough at each side of the barge disposed at a location intersecting the water level, the effective waterplane area of the barge is significantly reduced. Accordingly, the waterplane moment of inertia is lessened, thereby increasing the natural rolling period of the barge. In this manner the dynamic stability of the barge is increased and the barge is subject to less motion in response to wave action.

In addition, at both sides of the barge the topsurfaces 44S, P resist upward barge movement through the water in heaving and rolling motions. This is due, in main part, to forces imposed against the topsurfaces by the water mass located in the trough thereabove. Such upward movement resistance, in cooperation with downward movement resistance imposed by the bottom 18 of the barge, significantly dampens the heaving and rolling tendencies of the barge.

In order to maximize the intensity of such imposed forces, the topsurfaces 44S, P are preferably inclined relative to horizontal so as to extend outwardly and downwardly from the upstanding surface 40S, P. Desirably, the planes PS, PP defined by the topsurfaces 44S, P intersect closely adjacent to an imaginary line of intersection defined by the waterline and the vertical midplane of the barge. Such line of intersection generally approximates the actual center of rolling motion of the barge so that, in most instances, the topsurfaces 44S, P will project generally radially relative to the center of roll. As a result, the dampening forces acting upon the topsurfaces 44S, P will approach a generally perpendicular relationship with the respective moment arm PS, PP extending from the center of roll. For example, note the force F depicted in FIG. 3 which acts to dampen clockwise motion of the barge about the theoretical center of roll C. In this fashion, the resulting righting moment or couple acting on the barge will approach a maximum value. The amount of inclination of the topsurfaces can vary, depending upon various design criteria, although an angle in the range of about 4° to 10° has proven highly effective.

From the foregoing, it will be realized that the provision of troughs in the barge sides serves to reduce the metacentric height and thus increase the natural rolling period of the barge. In addition, the topsurfaces dampen upward rolling and heaving motions of the barge. Consequently, activities on the deck 24 can be more easily carried out.

It is important to note that any lessening of the static stability of the barge which may result from the reduction in metacentric height of the barge will tend to be compensated for by a maximization righting moment provided by the present arrangement. In this connection, it will be realized that the configuration of the top and bottom wing sections of the barge produces, in response to barge rolling motion, a significant lateral displacement of the center of buoyancy in a direction which establishes a relatively high righting couple. In this manner, any occuring reduction in static stability will not jeopardize overall safety requirements.

It is noted that the undersurfaces 38S, P of the upper wing sections 30S, P are oriented so as to minimize barge motion. In this connection, the undersurfaces of the upper wing sections are inclined relative to horizontal so as to extend outwardly and upwardly from the upright surfaces 40S, P. By virtue of such an arrangement, deflected waves will be less able to strike the undersurfaces. This serves to avoid undesirable vibration or other barge motion which could be caused by such wave action. It has been found that inclinations of at least 4° relative to horizontal are required for properly accomplishing this purpose, while an inclinatin of approximately 10° is believed suitable for most sea conditions since wave slope seldom exceeds 9°.

Uniquely combined with the previously described hull configuration is a buoyancy system which includes upper and lower ballast assemblies 50S, 50P and 52S, 52P for selectively ballasting and deballasting upper and/or lower portions of the barge.

The upper ballast assemblies 50S, 50P are arranged to selectively carry ballast fluid above the center of the barge. The lower ballast assemblies 52S, 52P are arranged to selectively carry ballast fluid below the barge center.

The ballast assemblies are preferably located in the upper wing sections and the lower wing sections. Each ballast assembly includes an enclosed, or fluid-tight, tank arrangement located within the respective wing section, with ballast equipment, including a conventional pump P for example, being provided to selectively impel ballasting fluid to and/or from the tanks. Some of the tanks may be utilized to carry fluid or solid supplies, such as fuel, oil, drinking water, or other usable substances which can be utilized as ballast.

This ballasting arrangement, wherein the barge can be ballasted or deballasted at points located above and/or below the barge center, provides significant advantages. In one instance, the center of gravity and metacentric height of the barge can be regulated, in any desired relationship to the barge draft, in order to vary the natural rolling period and thus the static and dynamic stability of the barge. Note, for example, that by ballasting the upper tanks 50S, P, the center of gravity is raised while decreasing the metacentric height. Consequently, the barge is rendered more stable dynamically, while increasing the draft of the barge. Of course, the greater barge draft reduces the wave-motion responsiveness of the barge.

Alternatively, the dynamic stability can be increased (by deballasting the lower tanks 52S, P) or decreased (by deballasting the upper tanks 50S, P), while decreasing the barge draft.

Moreover, by ballasting the upper tanks 50S, P and conjunctively deballasting the lower tanks 52S, P, the center of gravity can be raised while maintaining a generally constant draft. Such a generally constant draft can also be maintained while lowering the center of gravity by cooperatively ballasting the lower tanks 52S, P and deballasting the upper tanks 50S, P.

It will also be apparent that by conjunctively ballasting the upper and lower tanks 50S, P, 52S, P, the draft can be increased while maintaining a generally constant center of gravity.

In addition to being able to independently adjust the draft and center of gravity of the barge, the buoyancy system is ideally suited to regulate the natrual roll period of the barge. In this connection, it will be understood that ballasting and deballasting of the ballast tanks serves to vary the mass moment of inertia of the barge and thus change its natural rolling period. That is, an increased ballast will increase the natural rolling period, while a reduced ballast will decrease the natural rolling period.

It will be realized that a highly versatile operation of the barge is made possible by virtue of this arrangement. The center of gravity of the barge can be altered along with, or independently of, the barge draft to suit particular sea conditions. Also, the barge draft can be altered along with, or independently of, the center of gravity to accommodate various barge loads and maintain the wing sections sufficiently above the waves. Attention is directed to the following chart which demonstrates the versatility of barge operation.

| Operation | Draft | Center of Gravity (C.G.) | Natural Period of Roll (N.P.R.) |
|---|---|---|---|
| ballast upper and lower tanks | increase draft | generally maintain C.G. | increase N.P.R. |
| deballast upper and lower tanks | reduce draft | generally maintain C.G. | reduce N.P.R. |
| ballast upper tank and maintain lower tank | increase draft | raise C.G. | increase N.P.R. |

-continued

| Operation | Draft | Center of Gravity (C.G.) | Natural Period of Roll (N.P.R.) |
|---|---|---|---|
| deballast upper tank and maintain lower tank | reduce draft | lower C.G. | reduce N.P.R. |
| ballast lower tank and maintain upper tank | increase draft | lower C.G. | slightly increase N.P.R. |
| deballast lower tank and maintain upper tank | reduce draft | raise C.G. | increase N.P.R. |
| ballast upper tank and deballast lower tank | maintain draft | raise C.G. | increase N.P.R. |
| deballast upper tank and ballast lower tank | maintain draft | lower C.G. | reduce N.P.R. |

It will be realized that the actual effect which ballasting and deballasting has on the natural period will vary depending upon the design particulars of the barge and the amount of cargo being carried on the main deck or therebelow.

Figure 4:
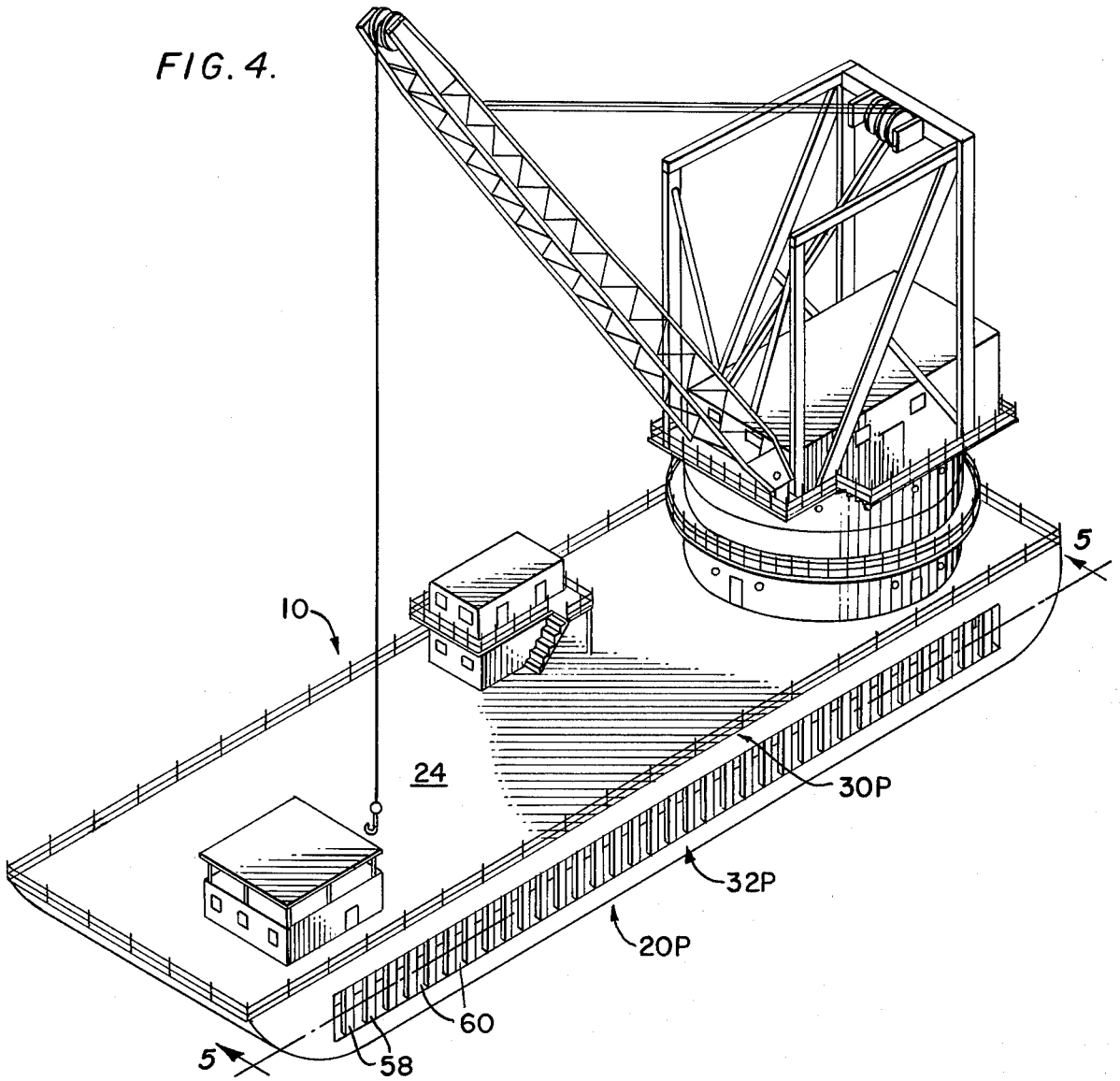
FIG. 4 is a perspective view of a barge in accordance with another preferred embodiment of the present invention.
Figure 5:
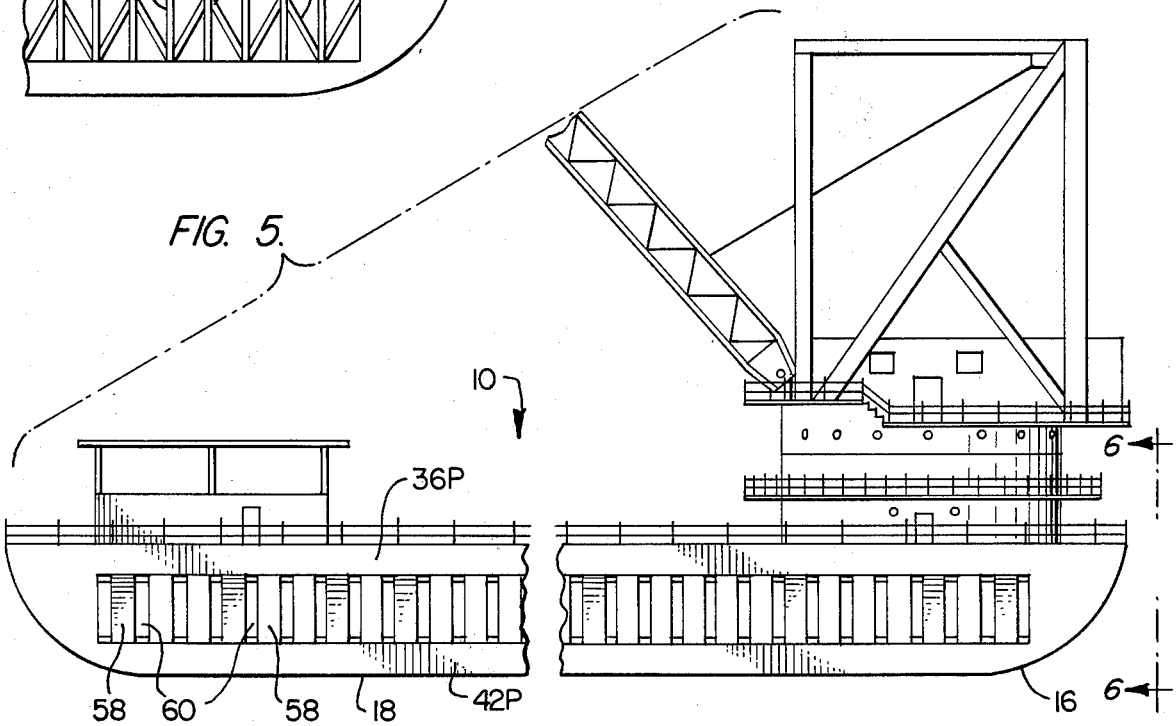
FIG. 5 is a side elevational view of the barge depicted in FIG. 4.

A further advantageous feature of the present invention involves the deployment of spaced plates 58 along the troughs 26S, P (FIGS. 4–6). The plates 58 define openings 60 extending vertically between the upper and lower wing tanks 30S, 32S and 30P, 32P, which openings freely admit water into the troughs. The plates 58 function to break the momentum of waves striking the sides of the barge and thereby dissipate energy which would otherwise be transmitted to the barge with motion-inducing effects. This feature is most effective in conjunction with waves having a height equal to or less than half the outer trough height.

It will also be realized that during periods where sea conditions tend to induce rolling of the barge, outward flow of water from within the trough during rolling action will be somewhat restricted by the plates 58. The size and number of the openings 60 can be determined for ideal conditions, to provide a phase difference of about 90° between movement of the ship and the flow of water from behind the plating. As the barge rolls, the side being immersed has its trough 26S or 26P filled with water, the water being admitted through the spaced openings. As the barge effects an upward roll, the water tends to flow outwardly through the horizontally spaced openings 60. The limited flow allowed by the openings causes a certain amount of water to be retained in the trough during upward rolling of the barge. This retained water acts on the plates to impart a righting movement which tends to couteract the rolling motion. A moment is thus developed which opposes the wave action, and thus partially dampens the rolling of the barge.

A modified form of a barge having plated troughs is depicted in FIG. 9 wherein a truss system 70 is attached across the mouth of the port and starboard troughs. This truss system includes vertical and diagonal plates 72, 74. These plates tend to break the momentum of waves which strike the barge sides as well as to restrict outward flow of water from the troughs. In addition, the truss system provides a highly effective reinforcement of the upper wing sections.

In order to evaluate the effectiveness of troughed barge sides, tank tests were performed on three scale-model barges, one being of the conventional untroughed type, another barge being of the type having unobstructed troughs as shown in FIGS. 1–3, and the other barge being of the type having plated troughs as shown in FIGS. 4–6. The conventional barge model was tested in waves having an average height of about 4 meters, and the barge models of the present invention were tested in waves of about 4.25 meters average height. The tests indicated a natural period of roll of about 11 seconds for the conventional barge model, about 19 seconds for the model having unobstructed troughs, and about 17.2 seconds for the model having plated troughs. It will thus be appreciated that the troughed sides contributed significantly in improving the dynamic stability of the barge models.

Figure 7:
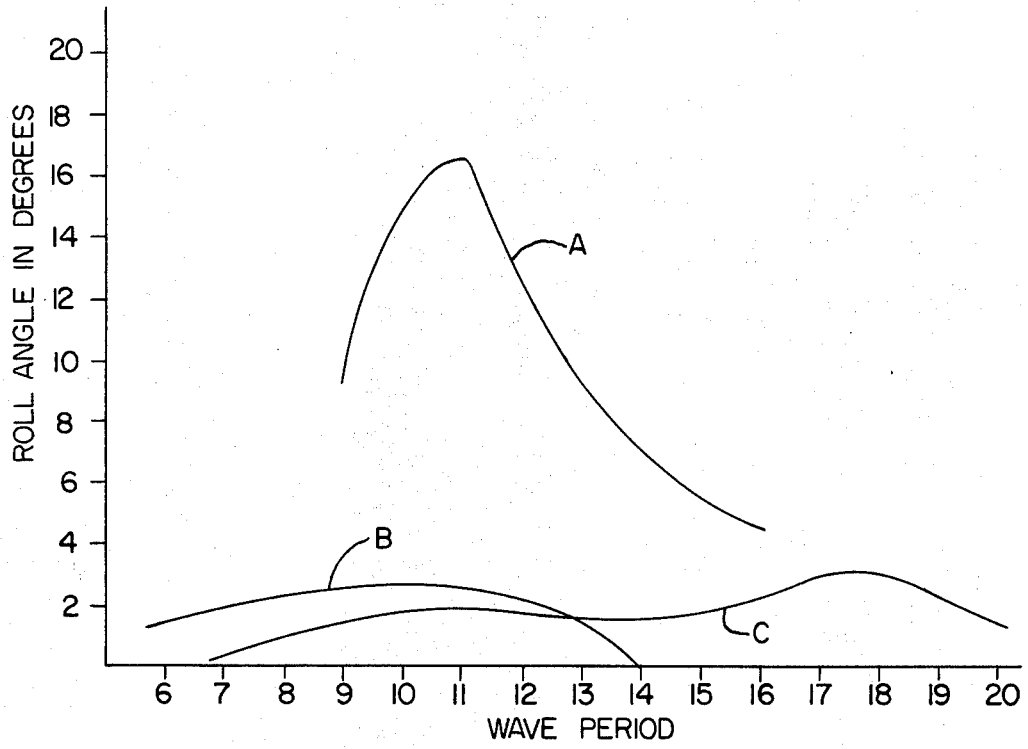
FIG. 7 is a graphic comparison of the roll responsiveness of barge scale models constructed in accordance with the present invention and a barge model constructed in accordance with a conventional design.

The tests further determined the wave responsiveness of the barge models in roll and heave. FIG. 7 depicts the roll responsiveness of a barge model of the conventional, prior art type (curve A), a barge model having unobstructed side troughs of the type shown in FIGS. 1–3 (curve B), and a barge model having plated side troughs of the type shown in FIGS. 4–6 (curve C).

Figure 8:
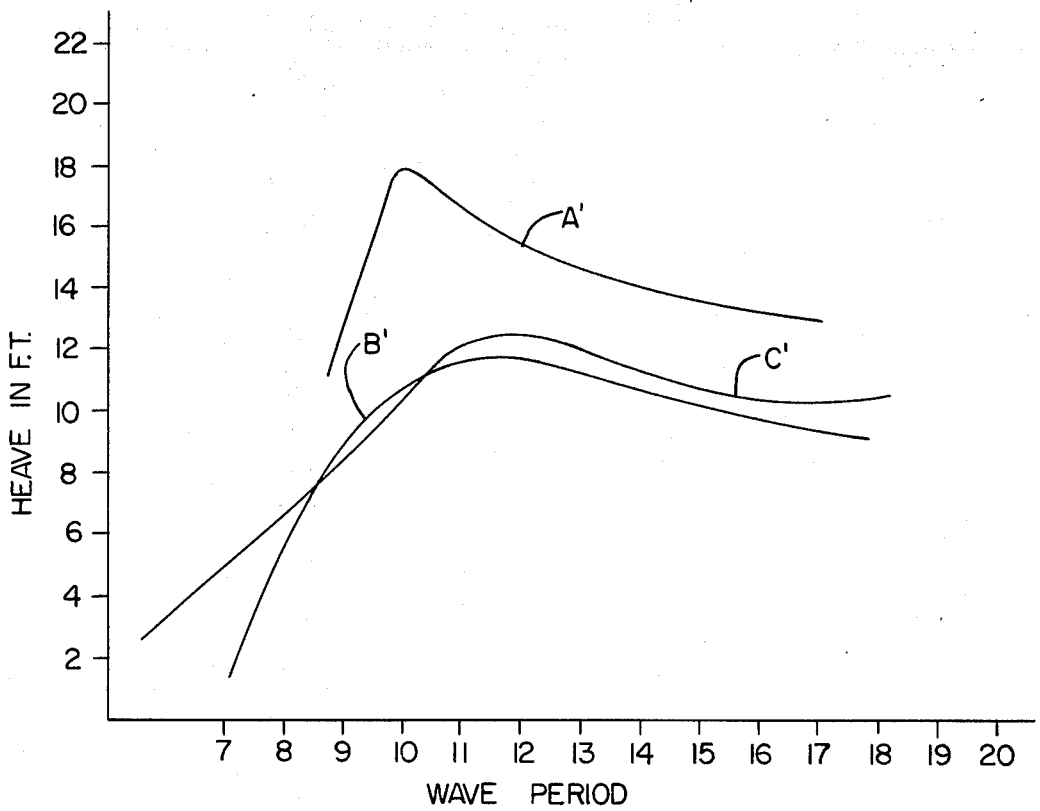
FIG. 8 is a graphic comparison of the heave responsiveness characteristics of the barge test models.

FIG. 8 represents the heave responsiveness of the conventional barge model (curve A′), a barge model having unobstructed side troughs (curve B′), and a barge model having plated side troughs (curve C′).

It is evidenced from these test results that the barge models designed with troughs in accordance with the present invention performed in a much superior manner over the conventionally designed barge model. This fact, when coupled with the further advantages to be realized as a result of the upper and lower buoyancy systems, indicates that the present invention stands as a significant contribution in the area of vessel performance.

SUMMARY OF MAJOR ADVANTAGES AND SCOPE OF THE INVENTION

The present invention enables the dynamic stability of a vessel, especially a barge, to be improved. Importantly, this improvement can be conveniently incorporated within existing barges.

The troughed sides of the barge serve to increase the natural rolling period of the barge and thus reduce wave motion responsiveness of the barge.

Dampening of barge motion in roll and heave is provided by the lower wing sections. The selected surface inclination of the top of the lower wing section maximizes the motion resisting forces.

The inclined undersurfaces of the upper wing sections minimize the potential vibration and motion of the barge due to deflected waves.

The plates which are spaced along the trough function to dissipate wave energy as well as to provide dampening of barge rolling motion. These plates are continually operable to admit water in virtually all operating conditions of the barge without the need for adjustment.

Control over barge motion by regulation of the center of gravity is made possible in a unique manner by the upper and lower ballast tanks. For example, increase and decrease of the metacentric height can be accomplished while increasing, decreasing, or maintaining the draft of the barge. Alternatively, the draft can be altered while increasing, decreasing, or maintaining the metacentric height. Importantly, the ballast tanks enable the natural rolling period of the barge to be adjusted, as well as providing added storage capacity.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A floatable vessel comprising:

a hull having top and bottom portions and port and starboard side portions, said top portion including a working deck capable of carrying personnel and equipment;

each of said port and starboard side portions including vertically spaced upper and lower wing sections which form an outwardly open, inwardly closed trough section vertically therebetween, each said trough section being bounded at the top by an outwardly directed undersurface of said upper wing section and at the bottom by an outwardly directed topsurface of said lower wing section;

each said trough section including a mouth extending between an outer end of said upper wing section and an outer end of said lower wing section to admit water into said trough section;

said topsurface of each said lower wing section being located for submersion during offshore operations to oppose upward motion of said vessel in heave and roll;

upper ballast tank means carried by said vessel and disposed to carry ballasting fluid above the center of said vessel;

means for ballasting said upper tank means to raise the center of gravity and reduce the metacentric height of said vessel, and deballasting said upper tank means to lower the center of gravity and increase the metacentric height of said vessel;

lower ballast tank means carried by said vessel and disposed to carry ballasting fluid below the center of said barge;

means for ballasting said lower tank means to lower the center of gravity and increase the metacentric height of said vessel, and deballasting said lower tank means to raise the center of gravity and reduce metacentric height of said vessel;

said trough sections and said upper ballast tanks, when ballasted, cooperating to provide mutually supplementary means operable to increase the natural roll period of said vessel in respone to a reduction in effective water plane area of said vessel, created by said trough sections, and a raising of the center of gravity of said vessel caused by ballasting of said upper ballast tanks;

said trough sections extending at least half the length of said vessel and being located so that the waterline of the body of water buoyantly supporting said vessel, in calm sea conditions, will intersect said trough sections vertically intermediate said undersurfaces and top surfaces thereof;

roll dampening means extending longitudinally along each of said trough sections and including means defining a series of longitudinally displaced openings, with said openings providing water passages for transmitting water between said water body and the interior of said trough sections, with said water passages being directed in generally port and starboard facing directions, extending above and below said waterline and intersected thereby, and being continuously operable to admit water into said trough sections, or permit inmpeded movement of water outward of said trough sections substantially throughout the height of said trough sections, and dampen rolling motion of said vessel;

said undersurfaces of said upper wing sections of said trough sections being inclined upwardly and outwardly and being operable, by virtue of said inclination, to reduce wave force acting thereon; and wave energy dissipating means comprising wall means, said wall means alternating with said water passages, longitudinally of said vessel, extending generally upright of said trough sections, and being operable to dissipate wave energy imparted to port or starboard sides of said vessel.

2. Apparatus according to claim 1 wherein said undersurfaces of said upper wing sections are inclined at an angle of at least 4° relative to horizontal.

3. Apparatus according to claim 2 wherein said topsurfaces are inclined by at least 4° relative to horizontal.

4. Apparatus according to claim 1 wherein said topsurfaces define planes which intersect to define a line that is generally coincidental with a line defined by the intersection of a vertical plane passing longitudinally through the transverse center of said vessel, and a plane representing said water line.

5. Apparatus according to claim 4 wherein said undersurfaces define planes passing through said defined line.

* * * * *